United States Patent [19]

Sines et al.

[11] 4,116,435

[45] Sep. 26, 1978

[54] AUTOMATIC CUE BALL SEPARATING DEVICE FOR BILLIARD TABLES

[75] Inventors: Randy D. Sines, P.O. Box 2006, Great Falls, Mont. 59403; John F. Curran, Spokane, Wash.

[73] Assignee: Randy D. Sines, Great Falls, Mont.

[21] Appl. No.: 779,252

[22] Filed: Mar. 18, 1977

[51] Int. Cl.[2] ..... A63D 15/00

[52] U.S. Cl. ..... 209/570; 209/657; 273/11 R

[58] Field of Search ..... 273/2, 11 R, 11 C, 14, 273/54, 59 R, 59 A, 59 B; 209/81 R, 81 A, 111.8, 223 R, 223 A

[56] References Cited

U.S. PATENT DOCUMENTS

| | | | |
|---|---|---|---|
| 680,759 | 8/1901 | Briggs | 273/11 |
| 1,957,222 | 5/1934 | Mershon | 209/81 R |
| 1,983,388 | 12/1934 | Moore | 209/81 R |
| 2,045,769 | 6/1936 | Geffcken et al. | 209/81 R |
| 2,150,440 | 3/1939 | Hargraves | 209/81 R |
| 2,504,731 | 4/1950 | Rose et al. | 209/81 R |
| 2,642,974 | 6/1953 | Ogle | 209/81 R |
| 2,825,565 | 3/1958 | Hooker | 273/125 |
| 3,140,093 | 7/1964 | Singer | 273/11 |
| 3,362,710 | 1/1968 | Feddick et al. | 273/11 |
| 3,392,829 | 7/1968 | Kelnanen | 209/111.8 |
| 3,424,456 | 1/1969 | Daddis | 273/11 |
| 3,441,132 | 4/1969 | Browning | 209/111.8 |
| 3,447,804 | 6/1969 | Cornell | 273/54 |
| 3,447,804 | 6/1969 | Cornell | 209/111.8 |
| 3,466,037 | 9/1969 | Miller | 273/11 |
| 3,498,611 | 3/1970 | Koler | 273/11 |
| 3,547,439 | 12/1970 | Feddick | 273/59 |
| 3,588,686 | 6/1971 | Lingmann | 209/111.8 |
| 3,662,710 | 1/1968 | Feddick et al. | 273/11 C |
| 3,738,655 | 6/1973 | Feddick et al. | 273/59 A |
| 3,917,264 | 11/1975 | Sines et al. | 273/3 R |
| 4,015,845 | 4/1977 | Sines | 273/11 C |

FOREIGN PATENT DOCUMENTS

| | | | |
|---|---|---|---|
| 869,563 | 1/1953 | Fed. Rep. of Germany | 209/81 R |
| 484,109 | 5/1938 | United Kingdom | 209/81 R |

*Primary Examiner*—Richard C. Pinkham
*Assistant Examiner*—T. Brown
*Attorney, Agent, or Firm*—Wells, St. John & Roberts

[57] ABSTRACT

An automatic cue ball separating device is described for billiard tables to separate a metallic containing cue ball from nonmetallic object balls. The cue ball separator includes an induction sensing coil that circumscribes the path of the balls along a return run with the balls passing through an aperture about which the coil loops are formed. The aperture is oblong with the coil mounted at the acute angle of less than 90° with respect to the path of the balls. The cue ball separating device includes an oscillating voltage means that is impedance matched with the induction sensing coil. When the metallic cue ball passes through the aperture, the oscillating electric field is disrupted causing the coil to change impedance. Such inductance change is detected by an electrical circuit which in turn operates a solenoid that engages the cue ball and drives the cue ball from the single file into a cue ball return channel to separate the cue ball from the object balls. The solenoid has a plunger axis that extends through the aperture of the coil. The solenoid contacts the ball while the cue ball is still within the influence of the electrical field.

9 Claims, 6 Drawing Figures

AUTOMATIC CUE BALL SEPARATING DEVICE FOR BILLIARD TABLES

BACKGROUND OF THE INVENTION

The present invention relates to the field of billiard table accessories, more particularly to devices for automatically separating a cue ball from the other object balls as the balls are conveyed from the billiard pockets to separate storage locations.

In coin operated billiard tables it has long been a problem to successfully separate the cue ball from object balls once the cue ball has been inadvertently "scratched" or dropped into one of the table's pockets during play. Ordinarily such tables are provided with return runs for the object balls that lead from each pocket to a common single file run. Balls received in any one of the six pockets will roll to the common single file return run and finally roll out into an access or storage area. A coin operated door or mechanism is normally situated at the access area or storage to prevent the object balls from being removed until a further coin is inserted. However, should the cue ball be inadvertently dropped into one of the pockets, the game is terminated unless the cue ball can be separated or returned to the playing table.

Proabably the approach most frequently used in separating the cue ball from the other object balls is to construct the cue ball slightly larger in diameter than the object balls so that physical separation can be made on the basis of ball diameter. Another commercially available process involves providing a cue ball with a ferrous material in the interior that may be influenced by a permanent magnet to separate the magnetic cue ball from the object balls. However, in such situations the cue ball generally has a greater weight than the object balls and consequently has a different momentum associated with its mass causing inaccuracies in the play on the table.

The applicant has previously devised a unique automatic cue ball separating device for separating a metal containing cue ball from other object balls in which the cue ball may be of the same weight as the object balls to overcome the previous disadvantages. The applicant's concept is incorporated in a patent application Ser. No. 658,251, filed Feb. 17, 1976 (U.S. Pat. No. 4,015,845) entitled "Automatic Cue Ball Separating Return Assembly for Billiard Tables".

One of the principal objects of this invention is to provide a significantly improved automatic separating device over the one previously designed by the applicant.

A further object of this invention is to provide an automatic cue ball separating device that is highly accurate and reliable.

A still further object of this invention is to provide an automatic cue ball separating device that is extremely economical to manufacture and reliable in operation.

An additional object of this invention is to provide a ball separating device that is extremely sensitive to cue balls containing rather small amounts of metallic material such as aluminum.

A still further object of this invention is to provide a unique automatic cue ball separating device in which the device can be separated from the object balls almost simultaneously the detection of its presence.

These and other objects and advantages of this invention will become apparent upon reading the following detailed description of a preferred embodiment.

BRIEF DESCRIPTION OF THE DRAWINGS

A preferred embodiment of this invention is illustrated in the accompanying drawings, in which.

DETAILED DESCRIPTION OF A PREFERRED EMBODIMENT

Figure 1:
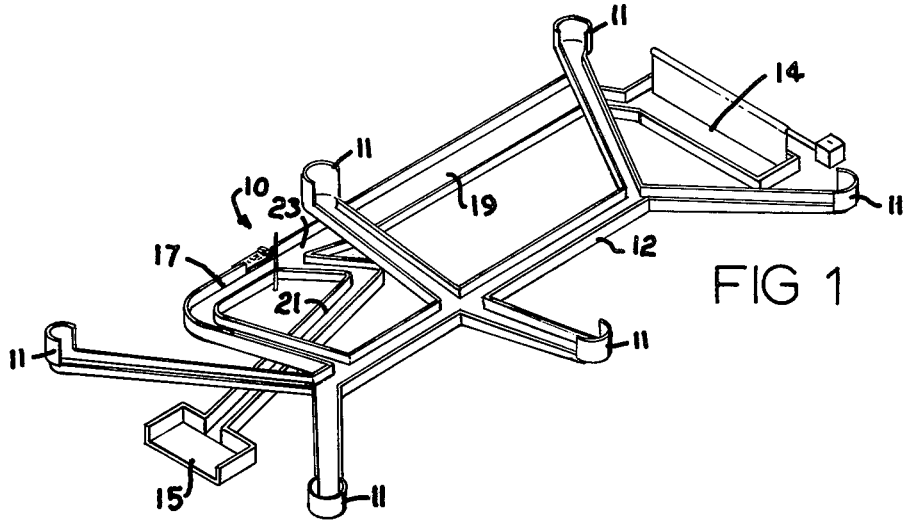
FIG. 1 is a schematic pictorial view of a ball return gravity conveying system for a billiard table illustrating an automatic cue ball separating device embodying the principal aspects of this invention.

Referring to the drawings, there is illustrated in FIG. 1 an automatic cue ball separating device 10 for incorporation in a billiard table having a plurality of billiard pockets 11. The billiard table includes a ball return gravity conveying system 12 that extends from he pockets to an object ball storage compartment 14 and a cue ball storage compartment 15. The conveying system 12 includes a single file ball run or common section 17 intermediate the pockets 11 and the playing ball storage compartment 14 and 15 along which both the object balls and the cue ball roll in single file. Conveying system 12 includes an object ball return section 19 that leads from the ball return 17 to the object ball storage compartment 14. A cue ball return section 21 extends from the single file ball return 17 to the cue ball storage compartment 15. The object ball return section 19 and the cue ball return section 21 intersect at a junction 23. Single file ball return 17 includes generally parallel spaced walls 25 and 26 for defining the sides of the ball return 17.

At the junction 23 the wall 26 has an opening 28 formed therein to provide communication with the cue ball return section 21. The cue ball contains a metallic substance such as a metallic core 16. Preferably the metal is aluminum.

Figure 4:
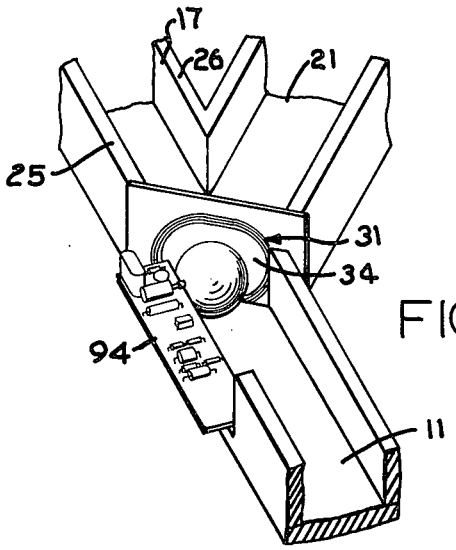
FIG. 4 is a perspective view of a section of the ball return conveying system compartment illustrating the automatic cue ball separating device from a different angle than that shown in FIGS. 2 and 3.
Figure 5:
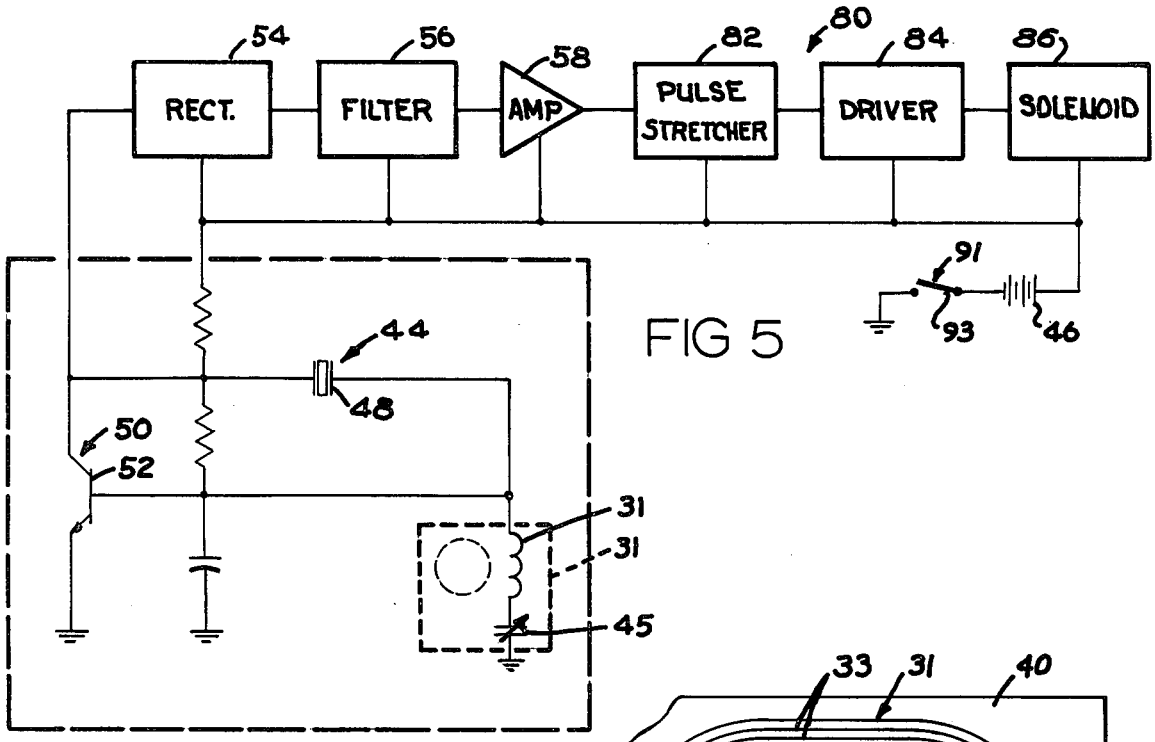
FIG. 5 is an electrical schematic view showing the major components of the automatic cue ball separating device in schematic block diagram form.

The automatic cue ball separator device 10 includes as one of its major components an induction sensing coil circuit 30 (FIG. 5) comprising an induction coil 31 formed of a plurality of encircling coil loops 33 (FIGS. 3, 4 and 5) in which each loop is substantially oblong shaped and encircles the path of the balls as they roll along the single file ball run 17.

The coil 31 has an oblong aperture 34 about which the loops 33 encircle to enable a ball to pass therethrough along the single file ball run 17. The aperture 34 has a minor dimension or height that is slightly greater than the diameter of the balls. The aperture 34 has a major dimension that is approximately between 1.1 and 1.5 times the minor dimension to enable the coil 31 to be positioned at an acute angle $\alpha$ of 45°–60° with respect to the flight of the balls along the single file ball return 17. Preferably, the major dimension is approximately 1.4 times the minor dimension and the coil 31 is mounted at a 45° angle with respect to the flight of the ball.

Figure 6:
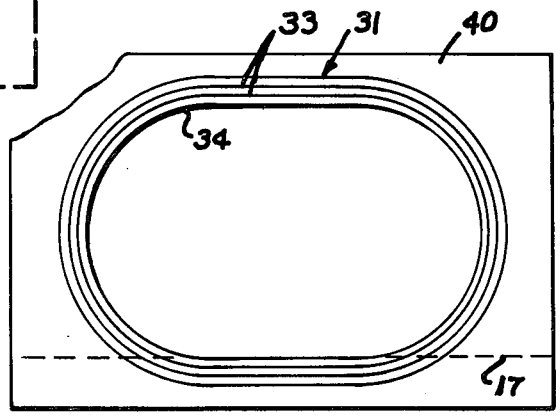
FIG. 6 is a fontal view of a component of the automatic cue ball separating device.

In a preferred embodiment the coil 31 is formed on a printed circuit board 40 with the loops 33 being etched on the board 40 circumscribing the aperture 34. The loops 33 are formed of concentric oblong rings immediately about the aperture 34 on the board 40 as illustrated in FIG. 6. The printed circuit board 40 is mounted in the single file ball return 17 at the desired acute angle $\alpha$ with the balls rolling through the oblong aperture 34. The aperture 34 is oblong shaped to enable the ball to roll through the obliquely mounted printed circuit board 40 without engaging the edges of the printed circuit board. The coil circuit 30 as illustrated in the electrical schematic of FIG. 5 includes an adjustable capacitor 45 mounted in series with the coil 31 to "tune" the coil to a desired frequency to develop a highly tunable resonant circuit.

The automatic cue ball separating device 10 further includes an oscillating voltage means 44 for providing a high frequency voltage to the coil 31 to cause the coil to generate a high frequency electrical field that is concentrated and focused in the aperture 34. In a preferred embodiment the oscillating voltage means 44 includes a source of electrical energy such as a battery 46 that powers a crystal oscillator 48. In a preferred embodiment, the crystal oscillator 48 is with the coil 31 and the adjustable capacitor 45. The adjustable capacitor 45 tunes the coil 31 to resonance with the crystal oscillator 48 to provide a rather high AC voltage output to a detection network means 50. When a cue ball having a metallic material contained therein (such as aluminum) passes through the aperture 34 and enters the oscillating electrical field of the coil 31 then the inductance of the induction sensing coil circuit 31 with respect to the oscillator 48 is disrupted which causes the detection network means 50 to identify the presence of the cue ball passing through the aperture 34. The detection network means 50 includes a base control transistor 52 that is connected to the induction sensing coil circuit 30. When a reduced voltage is applied to the base of the transistor 52 an electrical signal is passed to a rectification circuit 54 and then through a filter circuit 56 to an amplifier 58. The amplified signal is then passed to a deflection network means 80 which in turn deflects or causes the cue ball to be removed from the single file ball return 17, through the opening 28 into the cue ball return section 21. The deflection network means 80 includes means for engaging and deflecting the cue ball while the cue ball is passing through the aperture 34.

In the preferred embodiment the deflection network means 80 includes a pulse length circuit 82 that activates a driver circuit 84 for a selected period of time that is related to the transient period that a ball takes to pass through the aperture 34. The pulse length circuit 82 prevents double activation while a ball is passing through aperture 34. The driving circuit 84 then energizes a solenoid 86 (FIGS. 2, 3 and 5) that is mounted transverse to the path of the balls along the run 17. Solenoid 86 includes a plunger 88 that has an axis that projects through the aperture 34.

In a preferred embodiment the axis of the plunger 88 is normal to the path of the balls along the run 17. When the solenoid 86 is activated by the driver circuit 84 the plunger 88 moves outwardly into the path of the cue ball as the cue ball is present within the aperture 34 and drives the cue ball through the opening 28 into the cue ball return section 21. The location of the plunger 88 is important so that the deflection of the cue ball may be made while the cue ball is within the presence of the oscillating electrical field concentrated in the aperture 34.

Additionally in a preferred embodiment, the automatic cue ball separating device 10 includes a ball sensing means 91 that is associated with the detection network means 50 for sensing the presence of a cue ball or object ball moving along the ball return run 17. It is particularly advantageous to utilize a ball sensing means 91 in conjunction with a battery 46 to energize the electrical components and particularly the coil 31 only when a ball is present in the single file ball run 17. Such a feature reduces the amount of electrical energy required to operate the automatic cue ball separating device. When the billiard table is not being used then the ball sensing means 91 deactivates the electrical components.

In the preferred embodiment the ball sensing means 91 includes a feeler arm 92 that is biased outwardly into the path of the balls in the ball run 17. The feeler arm 92 is connected to an electrical switch 93 that is activated when the feeler arm 92 is engaged by a ball and is pushed or deflected by the ball as it moves along the ball return 17. Preferably the sensing or feeler arm 92 extends along the run 17 from a position upstream of the printed circuit board 40 and projects downwardly to a normal position extending into the aperture 34 so that the ball sensing means 19 is activated as the ball approaches the coil 31 and is only deactivated when a ball passes out of the electrical field of the coil 31.

Additionally in a preferred embodiment the voltage oscillating means 44, the deflection network means 80, and the ball sensing means 91 are mounted on a printed circuit board 94, that is positioned along the single file ball return 17. As an additional advantage, an edge 95 of the printed circuit board 94 forms a continuum of the wall 25 so that the balls roll along the edge 95. Consequently the automatic cue ball separating device 10 is very economical to install in a billiard table and serves as a structural part of the single file ball return 17. The components are mounted to the printed circuit board, including the solenoid 86.

Figure 2:
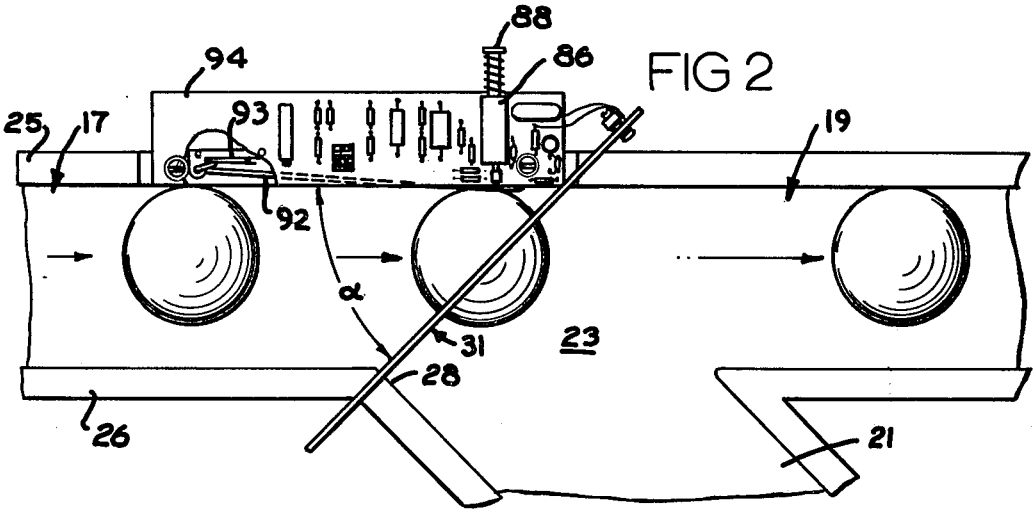
FIG. 2 is a fragmentary plan view of a single file ball return section of the ball return gravity conveying system illustrating the automatic cue ball separating device with the cue ball and the object balls rolling in a path along the single file ball return.
Figure 3:
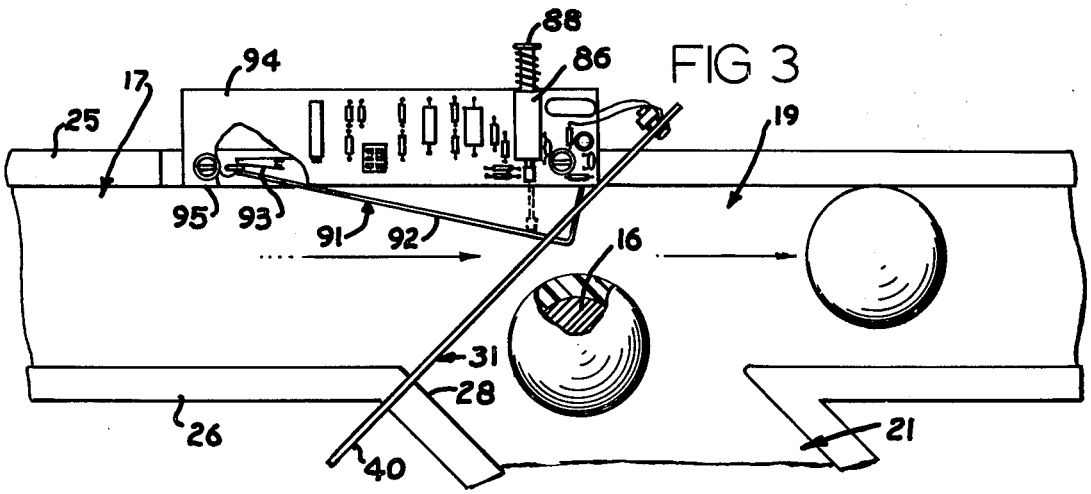
FIG. 3 is a plan view similar to FIG. 2 except showing the automatic cue ball separating device separating a metal containing cue ball from the single file run.

During the operation of the automatic cue ball device 10 as illustrated in FIGS. 2 and 3, the feeler arm 92 is first engaged by the balls and deflected inward to close the switch 93 which applies electrical power from the battery 46 to the various components. When an object ball passes through the aperture 34, it does not substantially disrupt the oscillating electrical field concentrated in the aperture 34 by the encircling loops 33 of the coil 31. Consequently the drive circuit 84 is not activated to deflect an object ball.

As the metallic containing cue ball enters the obliquely positioned aperture 34 it disrupts the oscillating electrical field therein which in turn reduces the voltage applied to the base controlled transistor 52 and causes a signal to be generated and amplified by amplifier 78 to activate the deflection network means 80. When this occurs the solenoid 86 is activated to move the plunger 88 rapidly transversely outward into the path of the cue ball in the aperture 34 and direct the cue ball as illustrated in FIG. 3 through the opening 28 and into the cue ball return section 21.

It should be noted that it is of particular advantage to be able to deflect the cue ball from the ball return while the cue ball is within the electrical field of the aperture or coil 31. By mounting the printed circuit board at an acute angle $\alpha$ such as 45° and providing an oblong aperture 34, a special combination of sensing and deflection can be carried on almost simultaneously. Such a feature provides for a very efficient accurate system that may be economically constructed and efficiently installed in a billiard table.

It should be understood that the above described embodiment is simply illustrative to the principles of this invention and that numerous other embodiments may be readily devised without deviating therefrom. Consequently, only the following claims are intended to define this invention.

What is claimed is:

1. An automatic cue ball separating device for separating a metallic containing cue ball from nonmetallic object balls in a billiard table, in which the billiard table has a single file ball return run along which the cue and object balls roll and a cue ball return run leading from a junction with the single file ball return run, comprising:

an induction sensing coil mounted on said table adjacent the junction having a plurality of encircling loops extending about a central aperture with the loops capable of generating a concentrated oscillating electrical field in the central aperture;

said central aperture having dimensions sufficient so that the sensing induction coil is transversely mounted at an acute angle significantly less than 90° to the path of the rolling balls in the single file ball return run and facing the cue ball return run with the balls rolling unobstructed through the central aperture;

voltage means operatively connected to the sensing induction coil for applying an AC voltage to the coil to generate an oscillating electrical field;

detecting network means operatively connected to the induction sensing coil for detecting the presence of the cue ball in the oscillating electrical field; and deflection means adjacent the central aperture and responsive to the detection of the cue ball passing through the central aperture for deflecting the cue ball from the single file ball return run to the cue ball return run while the cue ball is passing through the central aperture.

2. The automatic cue ball separating device as defined in claim 1 wherein the induction sensing coil includes a printed circuit board having a central aperture formed therethrough with the encircling coil loops being formed on a printed circuit board about the central aperture.

3. The automatic cue ball separating device as defined in claim 2 wherein the coil loops are formed concentrically on the printed circuit board.

4. The automatic cue ball separating device as defined in claim 1 in which the central aperture is oblong shaped.

5. The automatic cue ball separating device as defined in claim 4 wherein the major dimension of the central oblong aperture is between 1.1 and 1.5 times the minor dimension.

6. The automatic cue ball separating device as defined in claim 4 wherein the major dimension of the central oblong aperture is approximately 1.4 times the minor dimension.

7. The automatic cue ball separating device as defined in claim 1 wherein the deflecting means includes a solenoid mounted adjacent the ball return run in which the solenoid has a plunger axis that projects through the central aperture.

8. The automatic cue ball separating device as defined in claim 1 wherein the voltage means includes a crystal oscillator for generating an AC voltage.

9. The automatic cue ball separating device as defined in claim 8 wherein the induction sensing coil is operatively connected with the crystal oscillator and wherein the detection means includes an impedance matching circuit means for matching the impedances of the crystal oscillator and the induction sensing coil.

* * * * *